US012503752B2

(12) United States Patent
Pan et al.

(10) Patent No.: US 12,503,752 B2
(45) Date of Patent: Dec. 23, 2025

(54) LITHIUM STRIP

(71) Applicant: CONTEMPORARY AMPEREX TECHNOLOGY (HONG KONG) LIMITED, Hong Kong (CN)

(72) Inventors: Jianwei Pan, Ningde (CN); Shitong Chen, Ningde (CN); Bin Xie, Ningde (CN); Fenggang Zhao, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 464 days.

(21) Appl. No.: 18/330,490

(22) Filed: Jun. 7, 2023

(65) Prior Publication Data

US 2023/0313347 A1 Oct. 5, 2023

Related U.S. Application Data

(63) Continuation of application No. PCT/CN2022/100399, filed on Jun. 22, 2022.

(30) Foreign Application Priority Data

Sep. 27, 2021 (CN) ..... 202122350922.3

(51) Int. Cl.
*C22C 24/00* (2006.01)

(52) U.S. Cl.
CPC ..... *C22C 24/00* (2013.01)

(58) Field of Classification Search
CPC ..... C22C 24/00; H01M 10/052
See application file for complete search history.

(56) References Cited

FOREIGN PATENT DOCUMENTS

| | | | | |
|---|---|---|---|---|
| CN | 210837915 U | | 6/2020 | |
| CN | 111883739 A | * | 11/2020 | ..... H01M 4/0471 |
| CN | 112310342 A | | 2/2021 | |
| CN | 112838187 A | | 5/2021 | |
| CN | 215988895 U | | 3/2022 | |
| JP | H09330707 A | | 12/1997 | |

OTHER PUBLICATIONS

English Abstract and English Machine Translation of Li et al. (CN 111883739 A) (Nov. 3, 2020).*
ISR for International Application PCT /CN2022/100399 mailed Sep. 1, 2022.
Written Opinion for International Application Application PCT /CN2022/100399 mailed Sep. 1, 2022.

* cited by examiner

*Primary Examiner* — Jessee R Roe
(74) *Attorney, Agent, or Firm* — Ladas & Parry LLP

(57) ABSTRACT

A lithium strip that can be used in lithium supplementation equipment is described. The lithium strip has a first surface, and a thinned area is formed at the edge of the first surface along the width direction of the lithium strip to form a space for accommodating a release agent at the thinned area. The thinned area is designed to enable the lithium strip to pick up more release agent when it is applied to a coating device, and the release agent can remain in the above thinned area. The presence of the thinned area in the lithium strip can reduce the lithium load per unit width, so that during the calendering process of the lithium strip, there will be no calendering exceeding the preset width, so that the lithium strip will not stick to the roller after calendering.

10 Claims, 2 Drawing Sheets

LITHIUM STRIP

CROSS REFERENCE TO RELATED APPLICATIONS

The present application is a continuation of International application PCT/CN2022/100399 filed on Jun. 22, 2022 that claims priority to Chinese patent application No. 202122350922.3 filed on Sep. 27, 2021. The subject matter of these applications are incorporated herein by reference in its entirety.

TECHNICAL FIELD

The present application relates to the field of battery production, in particular to a lithium strip for lithium supplementation.

BACKGROUND ART

At present, environmental and energy issues have made social progress face a severe situation, and low-carbon environmental protection has become a major theme of future economic development. The storage and efficient utilization of energy has attracted wide attention, and lithium-ion battery cells exist as the smallest unit of energy storage. Energy saving and emission reduction are the key to the sustainable development of automobile industry, and electric vehicles have become an important part of the sustainable development of automotive industry due to their advantages of energy saving and environmental protection. For electric vehicles, battery technology is also an important factor related to their development. A battery is a structural form in which multiple battery cells are effectively connected, and a certain number of battery cells are connected in series/parallel/parallel-series to meet the demand for power supply for electrical device. In the application of battery cells, lithium-ion batteries are widely used in the field of consumer electronics and electric vehicles due to their advantages such as high energy density, long service life, and being green and pollution-free. However, a solid electrolyte film (SEI film) will be formed during the first charging and discharging process of lithium-ion batteries, and the solid electrolyte film will consume part of the lithium, resulting in the loss of lithium, and this irreversible loss of initial capacity directly leads to the loss of lithium-ion battery capacity. Therefore, how to supplement lithium has become a new problem.

SUMMARY OF THE INVENTION

The technical problem to be solved in the present application is to provide a new lithium strip for lithium supplementation to solve the problem of the lithium strip sticking to rollers of lithium supplementation equipment.

The present application is achieved as follows: a lithium strip used in lithium supplementation equipment including a coating device for coating a release agent, the lithium strip has a first surface facing the coating device, and a thinned area is formed at the edge of the first surface along the width direction of the lithium strip to form a space for accommodating the release agent at the thinned area. The thinned area is designed to enable the lithium strip to pick up more release agent when it is applied to the coating device, and the release agent can remain in the above thinned area. At the same time, the presence of the thinned area in the lithium strip can reduce the lithium load per unit width, so that during the calendering process of the lithium strip, there will be no calendering exceeding the preset width, thereby further ensuring that the lithium strip will not stick to the roller after calendering.

In one aspect of the present application, edges of the first surface along the width direction are provided with rounded corners, and the rounded corners form the thinned area. The advantage of edges with rounded corners is that it contributes to easy molding and simple manufacturing process. The edge of the rounded lithium strip is also not easy to scratch, and its shape can be preserved well.

In one aspect of the present application, the radius of the rounded corner is ¼ to ⅓ of the thickness of the lithium strip. The radius of the rounded corner of the lithium strip represents the total amount of thinning. If the thinning is too much, the weight of lithium at the edge of the lithium strip is likely to be insufficient. Too thinning during calendering may cause breakage at the connection position between the edge and the middle of the lithium strip, eventually leading to the phenomenon of lithium remaining at the edge. If the total amount of thinning is insufficient, the effect of increasing the total amount of the coated release agent will not be achieved. Therefore, it is selected to be ¼ to ⅓ of the thickness of the lithium strip, which is just the technical solution to achieve the effect.

In another aspect of the present application, the first surface is rounded on both sides of the edge along the width direction. Having the rounded corners on both sides enables the lithium strip to pick up more of the release agent on both sides of the production line, and the release agent can remain in the thinned areas on both sides. At the same time, neither side of the lithium strip will be calendered beyond the preset width during the calendering process, thereby further ensuring that the lithium strip will not stick to the roller after calendering.

In another aspect of the present application, the lithium strip further has a second surface, the first surface and the second surface are two opposite surfaces in the thickness direction of the lithium strip, and rounded corners are formed on both sides of the edge of the first surface along the width direction. Rounded corners are set on the second surface, which further reduces the lithium load per unit width of the lithium strip, especially reduces more lithium in the calendered part of the edge, so that the coated release agent can meet the demand on the release agent at the edge of the lithium strip after calendering.

In another aspect of the present application, edges of the first surface along the width direction are provided with chamfers which form a thinned area. Chamfers can be cut only by passing the lithium strip through a cutter at a specific angle. The chamfers can be conveniently cut and formed, which improves the production efficiency.

In some other embodiments of the present application, the height of the chamfer is ¼ to ⅓ of the thickness of the lithium strip. The radius of the chamfer of the lithium strip represents the total amount of thinning. If the thinning is too much, the weight of lithium at the edge of the lithium strip is likely to be insufficient. Too thinning during calendering may cause breakage at the connection position between the edge and the middle of the lithium strip, eventually leading to the phenomenon of lithium remaining at the edge. If the total amount of thinning is insufficient, the effect of increasing the total amount of the coated release agent will not be achieved. Therefore, the height of the chamfer is selected to be ¼ to ⅓ of the thickness of the lithium strip, which is just the technical solution to achieve the effect.

In another aspect of the present application, the first surface is chamfered on both sides of the edge along the width direction. Having chamfers on both sides enables the lithium strip to pick up more of the release agent on both sides of the production line, and the release agent can remain in the thinned areas on both sides. At the same time, neither side of the lithium strip will be calendered beyond the preset width during the calendering process, thereby further ensuring that the lithium strip will not stick to the roller after calendering.

In another aspect of the present application, the lithium strip further has a second surface, the first surface and the second surface are two opposite surfaces in the thickness direction of the lithium strip, and chamfers are formed on both sides of the edge of the first surface along the width direction. Chamfers are set on the second surface, which further reduces the lithium load per unit width of the lithium strip, especially reduces more lithium in the calendered part of the edge, so that the coated release agent can meet the demands on the release agent at the edge of the lithium strip after calendering.

In another aspect of the present application, the lithium strip has a rectangular cross-section. The rectangular structure has long and wide sides, and the first surface is the surface where the long side is located. The rectangular structure fits better with the coating device, and the rectangular lithium strip is easier to mold.

The above description is only a summary of the technical solutions of the present application. In order to be able to understand the technical means of the present application more clearly, the technical means can be implemented according to the content of the specification. Furthermore, to make the above and other objectives, features and advantages of the present application more comprehensible, specific implementations of the present application are exemplified below.

DESCRIPTION OF DRAWINGS

By reading the detailed description of the preferred implementations below, various other advantages and benefits will become apparent to those of ordinary skill in the art. The drawings are for the purpose of illustrating the preferred embodiments only and are not to be considered a limitation to the present application. Moreover, in all of the drawings, the same parts are indicated by the same reference numerals. In the drawings.

DESCRIPTION OF REFERENCE NUMERALS

Figure 1:
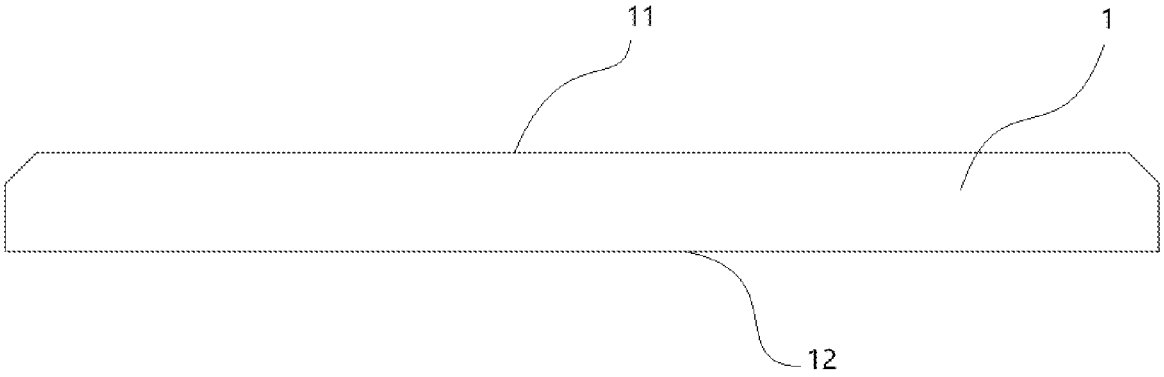
FIG. 1 is a schematic diagram of cross-section of a lithium strip according to an embodiment of the present application.

1. Lithium strip;
11. First surface;
12. Second surface;
2. Coating device;
20. Release agent;
3. Calendering roller;
4. Active material layer; and
5. Metal layer.

DETAILED DESCRIPTION

Embodiments of the technical solutions of the present application will be described in detail below in conjunction with the drawings. The following embodiments are only used to more clearly illustrate the technical solution of the present application, and therefore are only used as examples and cannot be used to limit the scope of protection of the present application.

Unless otherwise defined, all technical and scientific terms used herein have the same meaning as commonly understood by those skilled in the art belonging to the technical field of the present application; the terms used herein are intended only for the purpose of describing specific embodiments and are not intended to limit the present application; the terms "including" and "having" and any variations thereof in the specification and the claims of the present application and in the description of drawings above are intended to cover non-exclusive inclusion.

In the description of the embodiments of the present application, the technical terms "first", "second", and the like are used only to distinguish between different objects, and are not to be understood as indicating or implying a relative importance or implicitly specifying the number, particular order, or primary and secondary relation of the technical features indicated. In the description of the embodiments of the present application, the meaning of "a plurality of" is two or more, unless otherwise explicitly and specifically defined.

Reference herein to "an embodiment" means that a particular feature, structure, or characteristic described in connection with the embodiment can be included in at least one embodiment of the present application. The appearance of this phrase in various places in the specification does not necessarily refer to the same embodiment, nor is it a separate or alternative embodiment that is mutually exclusive with other embodiments. It is explicitly and implicitly understood by those skilled in the art that the embodiments described herein may be combined with other embodiments.

In the description of the embodiments of the present application, the term "and/or" is only an association relationship for describing associated objects, indicating that three relationships may exist. For example, A and/or B may represent three situations: A exists alone, both A and B exist, and B exists alone. In addition, the character "/" herein generally means that the associated objects before and after it are in an "or" relationship.

In the description of the embodiments of the present application, the term "a plurality of" refers to two or more (including two), and similarly, "multiple groups" refers to two or more (including two) groups, and "multiple sheets" refers to two or more (including two) sheets.

In the description of the embodiments of the present application, the orientation or position relationship indicated by the technical terms "center", "longitudinal", "transverse", "length", "width", "thickness", "upper," "lower," "front," "back," "left," "right," "vertical," "horizontal," "top," "bottom," "inner," "outer," "clockwise," "counterclockwise," "axial", "radial", "circumferential", etc. are based on the orientation or position relationship shown in the drawings and are intended to facilitate the description of the embodiments of the present application and simplify the description only, rather than indicating or implying that the device or element referred to must have a particular orientation or be constructed and operated in a particular orientation, and therefore are not to be interpreted as limitations on the embodiments of the present application.

In the description of the embodiments of the present application, unless otherwise expressly specified and limited, the technical terms "mount," "join," "connect," "fix," etc. should be understood in a broad sense, such as, a fixed connection, a detachable connection, or an integral connection; a mechanical connection, or an electrical connection; a direct connection, an indirect connection through an intermediate medium, an internal connection of two elements, or interaction between two elements. For those of ordinary skill in the art, the specific meanings of the above terms in the embodiments of the present application can be understood according to specific situations.

At present, from the perspective of the development of the market situation, power batteries are more and more widely used. The power batteries are used in energy storage power source systems such as hydraulic, thermal, wind and solar power stations as well as in electric vehicles such as electric bicycles, electric motorcycles and electric cars, and military equipment and aerospace fields. With the continuous expansion of the application field of the power batteries, the market demand is also constantly expanding.

However, the applicant noted that a solid electrolyte film (SEI film) will be formed during the first charging and discharging process of lithium-ion batteries, and the solid electrolyte film will consume part of the lithium, resulting in the loss of lithium, and this irreversible loss of initial capacity directly leads to the loss of lithium-ion battery capacity.

In order to reduce the decrease in battery capacity caused by the irreversible capacity of the battery during the first charging and discharging process, some patent documents have reported some solutions. For example, according to patent application No. 201911146508.1, the lithium supplementation technology described in this patent adopts the method of directly rolling lithium strips, so as to avoid the roller sticking problem caused by ultra-thin lithium strip (lithium film) being sticking to the first laminating roller or the second laminating roller after rolling. The lithium film sticking to the roller will cause the active material on the surface of the electrode sheet to be adhered to the lithium film. After multiple laminations, the active material will react with the lithium film, causing safety risks such as smoke or even fire. In order to avoid roller sticking, the surface of the lithium strip can be additionally coated with a release agent (glue) and a lubricant by dispensing glue on the edge, so as to ensure that in the high-speed rolling process of the lithium strip, the broadened area of the lithium strip resulting from broadening will not stick to the surface of the first laminating roller or the second laminating roller. However, this method of dispensing adds a process, requires manual intervention, and wastes time. Moreover, it is necessary to add a special edge dispensing coating head, and if the dispensing is uneven, there will still be roller sticking.

The battery cell disclosed in the embodiments of the present application can be used, but not limited to, in electrical apparatus such as a vehicle, a ship, or an aircraft. A power supply system of the electric apparatus can be composed of the battery cells and batteries disclosed in the present application.

Examples of the present application provide an electrical apparatus that uses a battery as a power supply, and the electrical apparatus may be, but is not limited to, a mobile phone, a tablet, a laptop, an electric toy, an electric tool, a battery vehicle, an electric vehicle, a ship, a spacecraft, and so on. The electric toy may include fixed or mobile electric toys, such as game consoles, electric car toys, electric ship toys, electric airplane toys, and the like. The spacecraft may include airplanes, rockets, space shuttles, spaceships, and the like.

On further reflection, the applicant considers that improving the shape of the lithium strip itself helps to coat more release agent. The roller sticking problem can also be improved by reducing the amount of lithium in the extended area and increasing the coating amount of the release agent per unit weight of lithium.

Reference is made to FIG. 1 which shows a lithium strip 1 used in lithium supplementation equipment including a coating device 2 for coating a release agent 20; the lithium strip 1 has a first surface 11 facing the coating device 2, and a thinned area is formed at the edge of the first surface 11 along the width direction of the lithium strip 1 to form a space for accommodating the release agent 20 at the thinned area.

The lithium strip 1 here is generally a pure lithium metal strip. Lithium is a metal element with the element symbol Li, and the corresponding simple substance is a silver-white soft metal, which is also the metal with the smallest density. Lithium is used in atomic reactors, and manufacturing of light alloys and batteries. Lithium and its compounds are not as typical as other alkali metals, because lithium has a large charge density and a stable helium-type double electron layer, which makes lithium easy to polarize other molecules or ions, but lithium itself is not easily polarized. It is a silver-white metal. It is soft and can be cut with a knife. It is the lightest metal, and its density is lower than that of all oils and liquid hydrocarbons, so it should be stored in solid paraffin or white petrolatum (lithium also floats in liquid paraffin). The density of lithium is very small, only 0.534 $g/cm^3$, which is the smallest among non-gaseous simple substances. Because of its small atomic radius, lithium has the least compressibility, the greatest hardness, and the highest melting point compared to other alkali metals.

The coating device 2 can be a coating roller, such as a gravure coating roller or a screen printing roller, which is used to absorb the release agent 20 and then transfer the release agent 20 to the contacted lithium strip 1.

As to the release agent 20, the release agent 20 is a functional substance between the mold and the finished product. The release agent 20 is chemically resistant and does not dissolve when in contact with different resin chemical compositions, especially styrene and amines. The release agent 20 also has heat and stress resistance performance, and is not easy to decompose or wear; the release agent 20 is bonded to the mold and not transferred to the workpiece to be processed, and does not hinder painting or other secondary processing operations. The release agent 20 can be of silicon series-mainly siloxane compounds, silicone oil, silicone resin methyl branched silicone oil, methyl silicone oil, emulsified methyl silicone oil, hydrogen-containing methyl silicone oil, silicone grease, silicone resin, silicone rubber, silicone rubber solution in toluene; wax series-plant, animal, synthetic paraffin; microcrystalline paraffin; polyethylene wax, etc.; fluorine series-polytetrafluoroethylene; fluororesin powder; fluororesin coating and other coatings. It is also known as glue or lubricant herein.

We can see from FIG. 1 that the first surface 11 is the upper surface of the lithium strip 1, and the left and right edges of the first surface 11 have been thinned to obtain thinned areas. In practical application, please refer to FIG. 2 here, which is a schematic diagram of the production line. The lithium strip 1 can be released through a front winding mechanism for the lithium strip 1 (not shown) and enter the coating device 2, so that the first surface 11 is coated with the release agent 20. The lithium strip 1 and the release agent 20 together are fed into the calendering roller 3 and then calendered into a thin sheet of lithium, and then the thin sheet of lithium is laminated onto the active material layer 4 of the battery assembly to complete lithium supplementation. Calendering in this embodiment is as follows. If the thickness of the flattened lithium strip 1 is reduced, its width increases significantly, and the extra width part is called the extended area. The extended area itself has no release agent 20, and it can only rely on the amount of the release agent 20 carried by the original lithium strip 1. The release agent is squeezed into the extended area to protect the lithium sheets in the extended area from sticking to the roller.

Therefore, the thinned area is designed to enable the lithium strip 1 to pick up more release agent 20 when it is applied to the coating device 2, and the release agent 20 can remain in the above thinned area. At the same time, the presence of the thinned area in the lithium strip 1 can reduce the lithium load per unit width. During the calendering process of the lithium strip 1, there will be no situation that the calendering exceeds the preset width. The load of the release agent 20 in the thinned area at the edge is increased, so that the release agent 20 will also be squeezed into the calendered area after the lithium strip 1 is calendered, thereby further ensuring that the lithium strip 1 will not stick to the roller after calendering.

Figure 3:
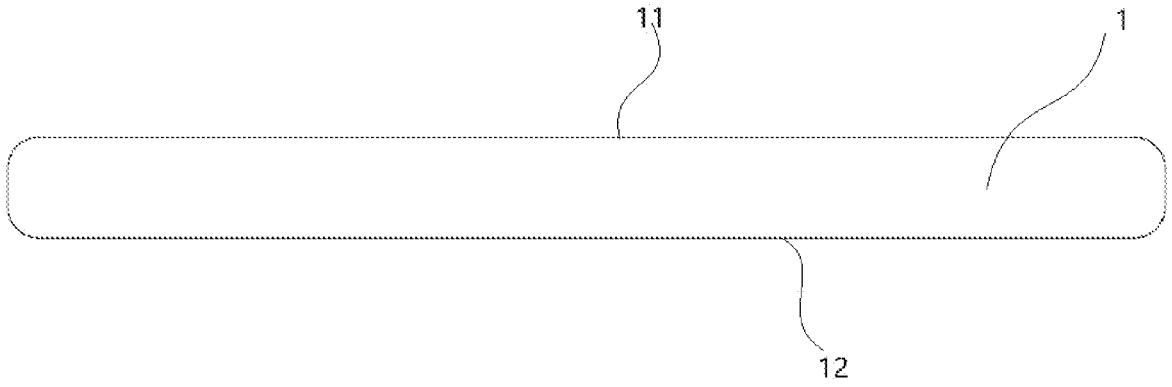
FIG. 3 is a schematic diagram of the state of the cross-section of the lithium strip according to an embodiment of the present application.

In one aspect of the present application, as shown in FIG. 3, edges of the first surface 11 along the width direction are provided with rounded corners, and the rounded corners form the thinned area. The thinned area formed through rounded corners can reduce the lithium load per unit width. During the calendering process of the lithium strip 1, there will be no situation that the calendering exceeds the preset width. The load of the release agent 20 in the thinned area at the edge is increased, so that the release agent 20 will also be squeezed into the calendered area after the lithium strip 1 is calendered, thereby further ensuring that the lithium strip 1 will not stick to the roller after calendering. The advantage of the thinned area at the edge with rounded corners is that it contributes to easy molding and simple manufacturing process. It is only necessary to arrange a rounded cutter or mold before the lithium strip 1 is sent into the coating device 2 to achieve the effect of arranging the thinned area at the edge with rounded corners. In some other embodiments, the lithium strip 1 can also be designed to be directly molded with a rounded rectangular cross-section at the beginning of molding. Then, the lithium strip 1 is wound and stored. The edge of the rounded lithium strip 1 is also not easy to scratch, and its shape can be preserved well.

In some embodiments of the present application, the radius of the rounded corner is ¼ to ⅓ of the thickness of the lithium strip 1. The radius of the rounded corner of the lithium strip 1 represents the total amount of thinning. In some embodiments of the present application, the thickness of the lithium strip 1 is set to be 1.6 mm, and the radius of the rounded corner is set to be 0.5 mm. The above arrangement is advantageous in that: if the thinning is too much, that is, the radius of the rounded corner is tow large, the weight of lithium at the edge of the lithium strip 1 is likely to be insufficient. Too thinning during calendering may cause breakage at the connection position between the edge and the middle of the lithium strip 1, eventually leading to the phenomenon of lithium remaining at the edge. If the total amount of thinning is insufficient, the effect of increasing the total amount of the release agent 20 coated will not be achieved. Therefore, the radius of the rounded corner is selected to be ¼ to ⅓ of the thickness of the lithium strip 1, which is just the technical solution to achieve the effect.

In some embodiments of the present application, as shown in FIG. 3, rounded corners are formed on both sides of the edge along the width direction of the first surface 11. Having the rounded corners on both sides enables the lithium strip 1 to pick up more of the release agent 20 on both sides of the production line, and the release agent 20 can remain in the thinned areas on both sides. Likewise, neither side of the lithium strip 1 will be calendered beyond the preset width during the calendering process, thereby further ensuring that the lithium strip 1 will not stick to the roller after calendering.

In another aspect of the present application, the lithium strip 1 further has a second surface 12, the first surface 11 and the second surface 12 are two opposite surfaces in the thickness direction of the lithium strip 1, and rounded corners are formed on both sides of the edge of the first surface 11 along the width direction. As in the embodiment shown in FIG. 3, the first surface 11 is the upper surface, and the second surface 12 is the lower surface. Rounded corners are arranged on the second surface 12, which further reduces the amount of lithium loaded per unit width of the lithium strip 1, especially reduces more lithium in the calendered part of the edge, which further ensures that there will be no calendering exceeding the preset width during the calendering process of the lithium strip 1. The load capacity for the release agent 20 in the thinned area of the edge is increased so that the weight of the release agent 20 corresponding to lithium per unit weight is further increased, which can meet the demand on the release agent 20 at the edge of the lithium strip 1 after calendering. Then technical problem of the lithium strip 1 sticking to the roller is better solved.

In some other embodiments of the present application, edges of the first surface 11 along the width direction are provided with chamfers which form the thinned area. Chamfers can be cut only by passing the lithium strip 1 through a cutter at a specific angle. The advantage of the thinned area at the edge with chamfers is that it contributes to easy molding and convenient tailoring. It is only necessary to arrange an inclined cutter before the lithium strip 1 is sent into the coating device 2 to achieve the effect of arranging the edge thinned area with rounded corners. In some other embodiments, the lithium strip 1 can also be designed to be directly molded with a chamfered rectangular cross-section at the beginning of molding. Then, the lithium strip 1 is wound and stored. The chamfers can be conveniently cut and formed, which improves the production efficiency.

In another aspect of the present application, the height of the chamfer is ¼ to ⅓ of the thickness of the lithium strip 1. The radius of the chamfer of the lithium strip 1 represents the total amount of thinning. In some embodiments of the present application, the thickness of the lithium strip 1 is set to be 1.6 mm, and the radius of the chamfer is set to be 0.5 mm. The above arrangement is advantageous in that: if the thinning is too much, the weight of lithium at the edge of the lithium strip 1 is likely to be insufficient. Too thinning during calendering may cause breakage at the connection position between the edge and the middle of the lithium strip 1, eventually leading to the phenomenon of lithium remaining at the edge. If the total amount of thinning is insufficient, the effect of increasing the total amount of the release agent 20 coated will not be achieved. Therefore, the height of the chamfer is selected to be ¼ to ⅓ of the thickness of the lithium strip 1, which is just the technical solution to achieve the effect.

In some embodiments of the present application, chamfers are formed on both sides of the edge along the width direction of the first surface 11. Having the chamfers on both sides enables the lithium strip 1 to pick up more of the release agent 20 on both sides of the production line, and the release agent 20 can remain in the thinned areas on both sides. Likewise, neither side of the lithium strip 1 will be calendered beyond the preset width during the calendering process, thereby further ensuring that the lithium strip 1 will not stick to the roller after calendering.

In some other embodiments of the present application, the lithium strip 1 further has a second surface 12, the first surface 11 and the second surface 12 are two opposite surfaces in the thickness direction of the lithium strip 1, and chamfers are formed on both sides of the edge of the first surface 11 along the width direction. Chamfers are arranged on the second surface 12, which further reduces the amount of lithium loaded per unit width of the lithium strip 1, especially reduces more lithium in the calendered part of the edge, which further ensures that there will be no calendering exceeding the preset width during the calendering process of the lithium strip 1. The load capacity for the release agent 20 in the thinned area of the edge is increased so that the weight of the release agent 20 corresponding to lithium per unit weight is further increased, which enables the coated release agent 20 to meet the demand on the release agent 20 at the edge of the lithium strip 1 after calendering.

In some embodiments of the present application, the cross-section of the lithium strip 1 is a rectangular structure. The rectangular structure has long and wide sides, and the first surface 11 is the surface where the long side is located. The rectangular structure fits better with the coating device 2, and the rectangular lithium strip 1 is easier to mold. In some other embodiments, the cross-section of the lithium strip 1 may also be trapezoidal, isosceles, elliptical, etc.

Figure 2:
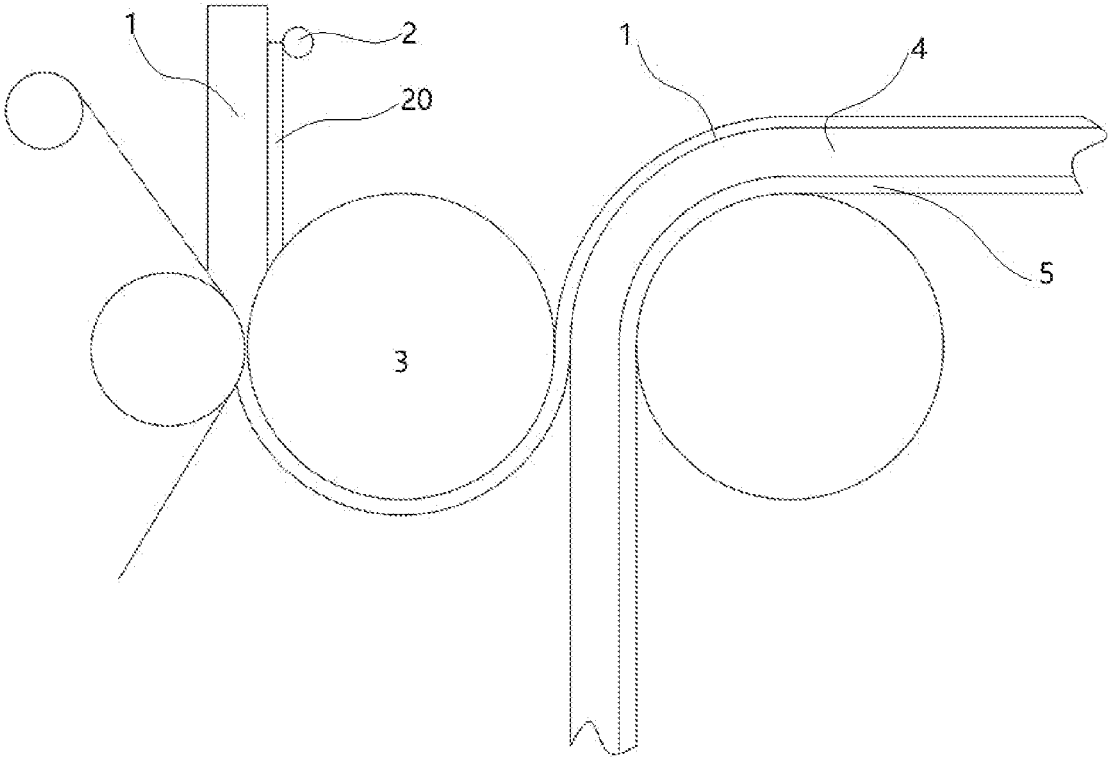
FIG. 2 is a schematic diagram of a coating device for the lithium strip according to an embodiment of the present application.

In some embodiments of the present application, reference is made to FIG. 1 and FIG. 2. The present application provides a lithium strip 1 used for a coating device for coating a release agent. The lithium strip 1 has a first surface 11 facing the coating device 2, and a thinned area is formed at the edge of the first surface 11 along the width direction of the lithium strip 1 to form a space for accommodating the release agent 20 at the thinned area. On the second surface 12 facing the first surface 11, a thinned area can also be formed. The thinned area can be arranged on the left and right sides of the first surface 11 and the second surface 12. The thinned area can be a rounded corner, or can be a chamfer. The lithium strip 1 enters the calendering roller 3 after being coated with the release agent 20 by the coating device 2, the thinned lithium strip 1 enters the next process, and is attached to the side of the active material layer 4 on the battery electrode sheet. The metal layer 5, the active material layer 4 and the lithium strip 1 are arranged in sequence to obtain a lithium-supplemented battery electrode sheet. The lithium strip 1 arranged as described above can prevent the sticking of lithium to the calendering roller 3.

The above-mentioned embodiments are only embodiments of the present application, and the scope of patent protection of the present application is not limited thereto. Any equivalent structure or equivalent process changes made by using the contents of the specification and drawings of the present application, or directly or indirectly applied in other related technical fields, are equally included in the scope of patent protection of the present application.

The invention claimed is:

1. A lithium strip wherein the lithium strip has a first surface, and a thinned area is formed at the edge of the first surface along the width direction of the lithium strip to form a space for accommodating a release agent at the thinned area.

2. The lithium strip according to claim 1, wherein the first surface is provided with rounded corners at the edge along the width direction, and the rounded corners form the thinned area.

3. The lithium strip according to claim 2, wherein the radius of the rounded corner is ¼ to ⅓ of the thickness of the lithium strip.

4. The lithium strip according to claim 2, wherein the first surface has rounded corners on both sides of the edge along the width direction.

5. The lithium strip according to claim 2, wherein the lithium strip further has a second surface, the first surface and the second surface are opposite to each other in the thickness direction of the lithium strip, and the first surface has rounded corners on both sides of the edge along the width direction.

6. The lithium strip according to claim 1, wherein the first surface is provided with chamfers at the edge along the width direction, and the chamfers form the thinned area.

7. The lithium strip according to claim 6, wherein the radius of the chamfer is ¼ to ⅓ of the thickness of the lithium strip.

8. The lithium strip according to claim 6, wherein the first surface has the chamfers on both sides of the edge along the width direction.

9. The lithium strip according to claim 6, wherein the lithium strip further has a second surface, the first surface and the second surface are opposite to each other in the thickness direction of the lithium strip, and the first surface has chamfers on both sides of the edge along the width direction.

10. The lithium strip according to claim 1, wherein the lithium strip has a rectangular cross-section.

* * * * *